US007081979B2

(12) United States Patent
Cotter et al.

(10) Patent No.: US 7,081,979 B2
(45) Date of Patent: Jul. 25, 2006

(54) BIT DIFFERENTIAL PROCESSING

(75) Inventors: David Cotter, Woodbridge (GB); Alistair J Poustie, Ipswitch (GB)

(73) Assignee: Corning Incorporated, Corning, NY (US)

( * ) Notice: Subject to any disclaimer, the term of this patent is extended or adjusted under 35 U.S.C. 154(b) by 889 days.

(21) Appl. No.: 10/215,847

(22) Filed: Aug. 8, 2002

(65) Prior Publication Data

US 2003/0048497 A1 Mar. 13, 2003

(30) Foreign Application Priority Data

Aug. 8, 2001 (GB) ..... 0119270.7

(51) Int. Cl.
*G06E 3/00* (2006.01)

(52) U.S. Cl. ..... 359/107; 359/108; 708/191

(58) Field of Classification Search ..... 359/107–108; 708/191

See application file for complete search history.

(56) References Cited

U.S. PATENT DOCUMENTS 5,900,956 A * 5/1999 Cotter ..... 359/108

FOREIGN PATENT DOCUMENTS

WO WO 99/49600 9/1999

OTHER PUBLICATIONS

A.J.Poustie, et al., "All-optical parity checker with bit-differential delay", Optics Communications, 162, pp. 37-43(1999).*

* cited by examiner

*Primary Examiner*—Leonidas Boutsikaris
(74) *Attorney, Agent, or Firm*—Gregory V. Bean

(57) ABSTRACT

There is provided an apparatus for processing a segment of x optical bit slots from a packet comprising y optical bit slots, each bit slot defining a respective one of first and second complementary logical states, within a time span shorter than or equal to the time for receipt of the packet. The apparatus including a segment replicator which generates serial copies of the segment of the packet, each copy residing within a respective word containing z bit slots, where z is equal to or greater than x; and a bit differential processor for processing successive bits of the successive copies of the segment in n successive processing steps, the product of n and z being less than or equal to y. The result of each processing step is output in sequence by the bit differential processor, the result of processing the segment being given by x successive bit slots of the output.

13 Claims, 3 Drawing Sheets

BIT DIFFERENTIAL PROCESSING

RELATED APPLICATIONS

This Application claims the benefit of priority under 35 U.S.C. § 119 of United Kingdom Patent Application No. 0119270.7, filed on Aug. 8, 2001, in the names of Alistair Poustie and David Cotter, the entire contents of which is incorporated herein by reference.

BACKGROUND OF THE INVENTION

1. Field of the Invention

This invention relates to the field of all-optical processing.

2. Technical Background

In the field of all-optical processing, optical signal streams are used for data processing applications. These optical streams consist of an optical pulse train that is divided into a series of bit slots. Each bit slot, which has a predetermined length within the pulse train, represents a single bit of data, with, for example, the presence or absence of an optical pulse within a bit slot representing complementary logical states. Thus, for example, the presence of a pulse may represent a binary "1", whilst the absence of a pulse may represent a binary "0", or vice versa.

It has long been a goal to produce devices capable of carrying out all optical processing. WO 99/14649 describes a 'bit serial' method and circuit which can perform serial calculations on sequential bits of an optical packet header to compare this with a locally generated word and divert the packet according to whether the header and word are identical or different. These circuits include optical signal feedback paths of a length equivalent to a 1-bit delay. Provided such feedback paths can be constructed, this method could be used for the purposes of address recognition in the time taken for receipt of the whole packet, ie 'on the fly' without danger of contention with a succeeding packet. For high-speed operation, the feedback path length must be short. For example, at a bit rate of 40 Gbit/s, a 1-bit delay requires a path length of 5 mm in silica, or about 2 mm in semiconductor. Such hardware devices are not yet readily implemented.

WO 99/49600 describes a circuit which uses 'bit differential processing' to determine the parity of a binary word. The circuit carries out a series of operations between sequential copies of the binary word with the result from the previous operation, the parity of the binary word being indicated by sequential bits of the resultant word. Unlike the serial packet receiver described in WO 99/14649, this circuit can be readily implemented, as it uses a multiple-bit optical regenerative memory having longer delay paths.

SUMMARY OF THE INVENTION

It is an object to provide a readily implementable method and device capable of processing optical packet information on the fly.

According to a first aspect of the present invention, there is provided an apparatus for processing a segment of x optical bit slots from a packet comprising y optical bit slots, each bit slot defining a respective one of first and second complementary logical states, within a time span shorter than or equal to the time for receipt of the packet, characterised in that the apparatus comprises:

(i) A segment replicator which generates serial copies of the segment of the packet, each copy residing within a respective word containing z bit slots, where z is equal to or greater than x; and (ii) a bit differential processor for processing successive bits of the successive copies of the segment in n successive processing steps, the product of n and z being less than or equal to y whereby the result of each processing step is output in sequence by the bit differential processor, the result of processing the segment being given by x successive bit slots of the output.

By using a bit differential processor to split the processing operation into several processing steps performed on serial copies of the segment, only multiple-bit regenerative memories are required to implement the method. Depending on the length of the segment to be processed, these multiple-bit regenerative memories require optical path lengths of the order of several cm, which can be readily implemented using fibre, planar waveguide technologies or hybrid integrated components. Furthermore, provided that the product of n and z is less than or equal to y, the segment may be processed within a time span corresponding to the time for receipt of the packet such that contention with a succeeding packet may be avoided and the segment may be processed on the fly.

Preferably, the segment to be processed comprises the packet header, the apparatus further comprising a header extractor for providing a copy of the header to the segment replicator.

The bit differential processor may comprise a parity calculator, in which case the apparatus may be used in a packet discarder circuit (ie. a circuit used to discard a packet with a header containing a bit error). Alternatively, the bit differential processor may comprise an address comparator. Such an apparatus could be used in a packet receiver circuit. In either case, the apparatus may comprise an optical space switch for routing the packet according to the output from the bit differential processor.

According to a second aspect of the present invention, there is provided a method of processing a segment of x optical bit slots from a packet comprising y optical bit slots, each bit slot defining a respective one of first and second complementary logical states, using an all-optical switching device within a time span shorter than or equal to the time for receipt of the packet, characterised in that the method comprises the steps of:

(i) generating serial copies of the segment of the packet, each copy residing within a respective word containing z bit slots, where z is equal to or greater than x; and (ii) processing successive bits of the successive copies of the segment in n successive processing steps, the product of n and z being less than or equal to y, whereby the result of each processing step is output in sequence, the result of processing the segment being given by x successive bit slots of the output.

In order that the invention may be more fully understood embodiments thereof will now be described by way of example only, reference being made to the accompanying drawings in which:

DETAILED DESCRIPTION

Figure 1:
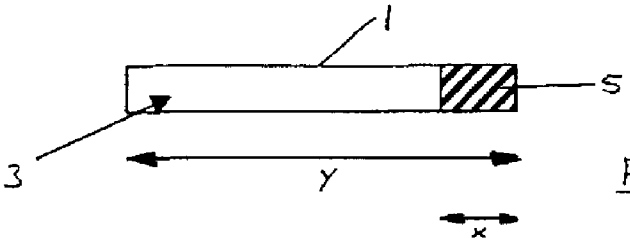
FIG. 1 shows a schematic representation of an optical packet.

An optical packet 1, as shown in FIG. 1, comprises a payload 3 of data preceded by a header 5, which carries the destination address needed for routing in the photonic network. The packet contains y optical bit slots in total, of which x are comprised in the segment occupied by the header.

In networks that transfer data in packets, it is a common problem that incorrectly addressed packets continue to propagate around the network indefinitely. One possible way to reduce the number of incorrectly addressed packets propagating in a network is to only use addresses with even (or odd) parity and then eliminate all packets which have an address of the opposite parity. Thus, a packet discarder system must be able to detect the address of a data packet, which is usually stored in the packet header, determine the parity of the address and output the packet from different outputs depending on the parity.

Figure 2:
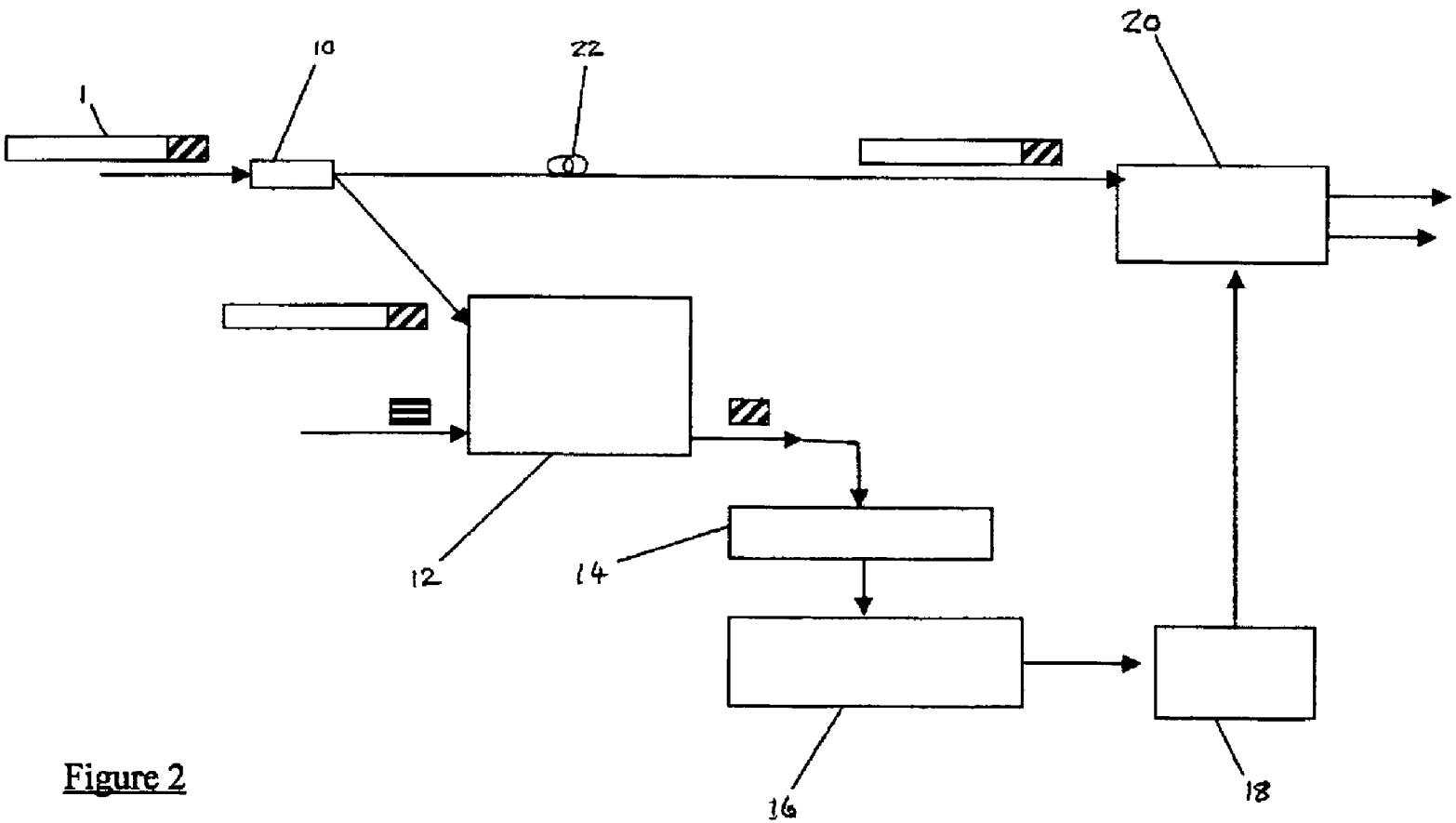
FIG. 2 shows a schematic representation of a packet header processor according to the invention.

A packet header processor according to the invention, which may be used to discard all-optical data packets, is shown in FIG. 2. The processor comprises an optical coupler 10 which splits the incoming signal, comprising one or more optical packets 1, along two paths. A first path leads the signal to a first input of an optical AND gate 12, the second input of which is connected to a pulse stream generator (not shown), which generates a series of pulses over a period equal in length to that of a packet header.

Figure 3A:
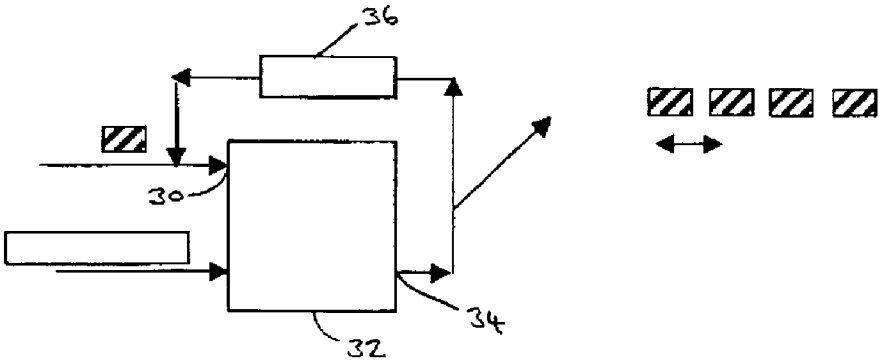
FIG. 3*a* shows a schematic representation of an optical memory.
Figure 3B:
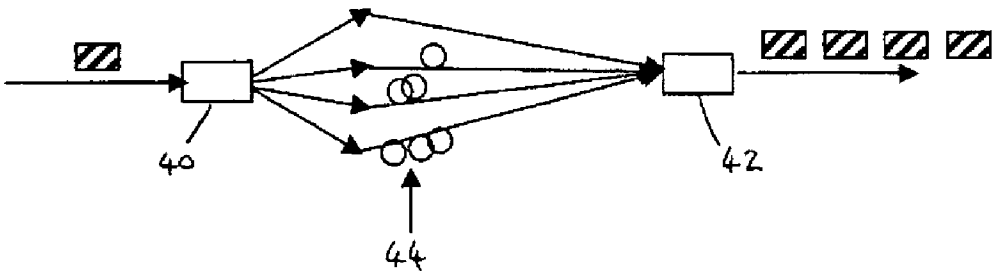
FIG. 3*b* shows a schematic representation of an optical splitter/combiner.

The output from the AND gate is fed to a segment replicator 14. This can be implemented in a number of ways, two possible embodiments of which are shown in FIGS. 3*a* and 3*b*. In one embodiment of the segment replicator shown in FIG. 3*a*, the output from the AND gate is fed to a control port 30 of an all optical non-linear gate or TOAD switch 32 (2×2 switch) configured as a signal regenerator. The other input port of the TOAD switch is coupled to a synchronised local clock source. The output 34 of the TOAD switch 32 is coupled to the control port 30 via a feedback loop. The feedback loop is formed from a delay line 36, which introduces a time delay equivalent to the x optical bit slots occupied by the header. In this way, the segment replicator shown in FIG. 3*a* comprises an optical memory circuit which continues to regenerate and output serial copies of the input segment until the input clock source is reset to zero.

In an alternative segment replicator shown in FIG. 3*b*, the output from the AND gate is fed to a first 1×N coupler 40 which splits the signal along N different paths to a second 1×N coupler 42, which recombines the signals onto the output path. The N different paths comprise separate delay lines 44, each delay corresponding to a different multiple of x bit slots, which result in N sequential copies of the input segment when recombined onto the output path. In this embodiment N=x.

Figure 4:
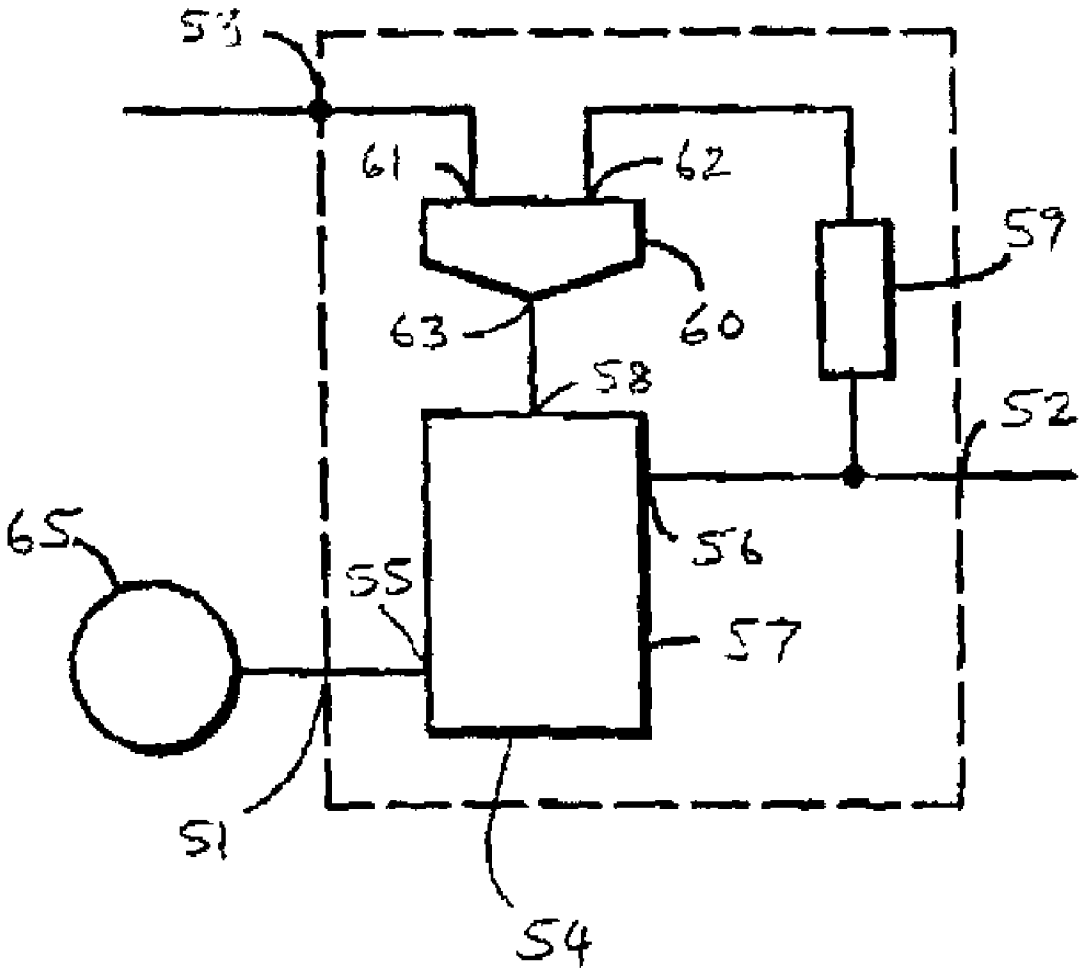
FIG. 4 shows a schematic representation of a regenerative memory circuit.

The output from the segment replicator 14 is coupled to a bit differential processor 16. For the purposes of this example, the bit differential processor comprises a regenerative memory circuit as shown in FIG. 4. The memory circuit, which has a memory input port 51, a memory output port 52 and a memory word input port 53, comprises an all optical non-linear gate 54. The gate input 55 is connected via the memory input port 51 to a pulse stream generator 65 which generates a continuous stream of optical pulses. The first gate output 56 is connected to the memory output port 52 and, via a feedback loop with a delay line 59, to an all optical combiner 60. The all optical combiner 60 has a combiner output 63 connected to the gate switching input 58 of the gate 54 along with two combiner inputs 61, 62. The optical combiner 60 and optical gate 54 act as an XOR gate. This is due to the gate 54 only being switched by the reception of a bit slot containing a single optical pulse which acts as a switching signal. The first combiner input 61 is connected to the memory word input port 53 for receiving an x+1 bit slot optical word to be stored, whilst the second combiner input 62 is connected to the first gate output port 56, via the delay line 59. The delay line 59 introduces a time delay equivalent to x+1 bit slots to the data flow from the gate output to the combiner input.

With no optical pulses applied to the memory word input 53, the stream of optical pulses supplied to the memory input port 51 will be output from the second gate output 57 of the gate 54. The output from the segment replicator 14, which comprises sequential copies of the input segment, each of x bit slots in length, is input to the memory word input 53 and transferred via the optical combiner 60 to the gate switching input 58. This input acts as a series of switching signals. Thus, as each bit slot of the input is applied to the switching input, it will cause a copy of the contents of the bit slot to be output from the first gate output 56. So, for example, if the first bit slot contains an optical pulse, this will act as a switching signal causing a single optical pulse to be transferred from the optical pulse stream supplied to the gate input 55 to the first gate output 56. This optical pulse will then be output from the output port 52 with a copy of the pulse being fed back via the delay line 59, to the combiner 60. As the delay line 59 introduces an x+1 bit slot delay, this first bit slot containing an optical pulse will not reach the second combiner input 62 until x+1 bit slots of the input have been transmitted through the combiner 60.

Supposing the second bit slot of the input contains no optical pulse, then it does not act as a switching signal and the optical pulse in the corresponding bit slot in the input optical pulse stream will be transferred to the second gate output 57. Accordingly, an empty bit slot will be output from the first gate output 56, which will again be fed back via the delay line to the second combiner input 62.

The process is repeated for all the x+1 bit slots of the input such that a copy of the first x+1 bits of the input is generated at the second gate output 56. As mentioned with respect to each bit slot, the input is copied with one copy being available for output from the memory 50 at the memory output port 52, whilst the other copy is fed back to the optical combiner 60, via the delay line 59. The first bit slot of this copied input represents the parity of the first bit slot of the original x bit slot input segment. Accordingly, the signal stream generated at the gate output 56 is a parity word, the first bit slot of which represents the parity of the first bit slot of the original input segment.

As the delay line 59 delays the transfer of the input by x+1 bit slots, the first bit slot of the copied input (the first parity determinant) will reach the input 62 of the optical combiner immediately after the first bit slot of the second of the input segment series generated by the segment replicator has been input into the input 61 of the combiner 60. Thus, the combiner receives the first parity determinant at input 62 and the second bit slot of the second of the input segment series at input 61 simultaneously. As described above, the combiner 60 and the non-linear gate 54 act to generate the exclusive OR of the bit slots applied to the first and second combiner inputs 61, 62 respectively at the gate output 56.

Accordingly, the signal output from the gate output 56 represents the XOR combination of the first parity determinant and the second bit slot of the second of the input segment series, which effectively represents an updated parity determinant of the first two bit slots of the original x bit slot length input segment.

By repeating this process, with the most recently generated parity determinant being offset by a single bit slot and XOR-ed with the next corresponding bit slot of the following of the input segment series generated by the segment replicator, a parity word representing the parity of all x bit slots of the input segment can be generated.

The second path from the optical coupler 10 leads the signal via a delay line 22 to an optical space switch 20 having two output paths. The output from the bit differential processor 16 leads to an optical space switch control circuit 18, which in turn selects the appropriate output path from the optical space switch 20 depending on the output received from the bit differential processor 16.

In operation, an incoming signal comprising an optical packet 1 is split along first and second paths by the optical coupler 10. The optical packet travelling along the first path arrives at the first input of the optical AND gate 12. The second input to the optical AND gate is fed with a signal from a pulse stream generator. The signal comprises a series of pulses followed by a window, the pulses being synchronised with, and of the same bit rate and duration as, the header, and the window being synchronised with, and of the same duration as, the payload. As the pulse stream and packet are synchronised, the AND gate enables the header to pass on to the segment replicator, while the payload is prevented from passing. The segment replicator generates serial copies of the header and feeds these to the bit differential processor 16.

As shown above, the bit differential processor 16 carries out a series of operations on successive bits of the successive copies of the input segment generated by the segment replicator 14 to generate a parity word representing the parity of all x bit slots of the input segment. This parity word is coupled to the optical space switch control circuit 18, and depending on whether the parity of the input segment (ie the header) is odd or even, the switch control circuit selects one or other of the output paths from the optical space switch 20. The switch control circuit 18 could be implemented by means of an appropriate optical or electronic control circuit. The appropriate output path from the optical space switch is selected just prior to receipt of the packet 1 along the second path from the optical coupler 10 and delay line 22.

Provided that the bit differential processor can perform its parity calculation within the time span corresponding to the time for receipt of the total packet, contention with succeeding packets may be avoided, and the packet header information may be processed on the fly. In the above example, the segment replicator produces a series of copies of the input segment (header) without any spacing between each copy, such that each copy of the input segment resides within a respective word containing x bit slots. The bit differential processor requires x copies of the input segment to carry out x successive processing steps to complete the parity calculation (each processing step comprising transmission of one copy of the segment through the processor). Therefore in order to process the header information on the fly, this would require that $x^2 \leqq y$.

However, it may be desirable for the circuit to be designed to process longer segments than the header of the above example. In this case, each copy of the segment generated by the segment replicator would reside within a respective word containing one or more empty bit slots depending on the length of each word generated by the segment replicator. Likewise, one could conceive a bit differential processor which processes several bits of each copy of the segment in each processing step, so requiring fewer than x processing steps to complete the parity calculation. If we take the number of bit slots copied by the segment replicator as z, and the number of processing steps required to complete the parity calculation as n, then the number of bit slots required to perform the parity calculation would be the product of z and n. Thus, to satisfy the requirement for processing on the fly, $zn \leqq y$.

Circuits according to the invention may suitably process information contained in a packet header, as described above. However, a circuit could easily be modified to process information contained in a segment located at any other section of a packet, for example at the trailing end of the packet, or even distributed at several locations along the length of the packet. This would simply require an appropriate pulse/window generator to extract the segment from its location in the packet, and a longer delay line in the second optical path from the coupler. Such a modification would still enable processing on the fly of the information contained in the segment.

Although the embodiment of the invention described above is a packet discarder which uses a bit differential processor circuit to determine the parity of the header segment, it will be clear to those skilled in the art of optical circuit design that the invention encompasses other apparatus for processing optical information on the fly. For example, the bit differential processor could comprise an address comparator to enable the circuit to compare the address encoded in the header with a local address and route the packet accordingly. It is important that whatever circuit is employed, it should operate as a bit differential processor to split the processing operation into several processing steps performed on serial copies of a segment of a packet. In this way, only multiple-bit regenerative memories are required which employ optical path lengths of the order of several cm. Such optical path lengths are readily implemented using fibre, planar waveguide technologies or hybrid integrated components.

Any discussion of the background to the invention herein is included to explain the context of the invention. Where any document or information is referred to as "known", it is admitted only that it was known to at least one member of the public somewhere prior to the date of this application. Unless the content of the reference otherwise clearly indicates, no admission is made that such knowledge was available to the public or to experts in the art to which the invention relates in any particular country (whether a member-state of the PCT or not), nor that it was known or disclosed before the invention was made or prior to any claimed date. Further, no admission is made that any document or information forms part of the common general knowledge of the art either on a world-wide basis or in any country and it is not believed that any of it does so.

What is claimed is:

1. Apparatus for processing a segment of x optical bit slots from a packet comprising y optical bit slots, each bit slot defining a respective one of first and second complementary logical states, within a time span shorter than or equal to the time for receipt of the packet comprising:

(i) a segment replicator which generates serial copies of the segment of the packet, each copy residing within a respective word containing z bit slots, where z is equal to or greater than x; and (ii) a bit differential processor for processing successive bits of the successive copies of the segment in n successive processing steps, the product of n and z being less than or equal to y, whereby the result of each processing step is output in sequence by the bit differential processor, the result of processing the segment being given by x successive bit slots of the output.

2. Apparatus according to claim 1, wherein the segment to be processed comprises the packet header, the apparatus further comprising a header extractor for providing a copy of the header to the segment replicator.

3. Apparatus according to claim 2, wherein the header extractor comprises an optical AND gate, the packet being fed to one input of the AND gate, and a synchronised pulse stream of z optical bit slots being fed to the other input of the AND gate.

4. Apparatus according to claim 1, wherein the segment replicator comprises:

(i) a TOAD switch configured as a signal regenerator; and (ii) a feedback path incorporating a z bit slot delay which introduces the output from the TOAD switch to the input after transmission of the segment through the TOAD switch, whereby the segment residing within a word containing z bit slots is repeatedly regenerated.

5. Apparatus according to claim 1, wherein the segment replicator comprises:

(i) a first 1×N coupler for splitting the input signal into N output lines, N being greater than or equal to n;

(ii) a separate delay line associated with each of the outputs from the coupler, each delay corresponding to a multiple of z bit slots; and (iii) a second 1×N coupler for recombining the signals from each of the delay lines, whereby at least n serial copies of the segment, each residing within a word containing z bit slots, are output from the second coupler.

6. Apparatus according to claim 1, wherein the bit differential processor comprises a parity calculator.

7. Apparatus according to claim 1, wherein the bit differential processor comprises an address comparator.

8. Apparatus according to claim 6, further comprising an optical space switch for routing the packet according to the output from the bit differential processor.

9. Apparatus according to claim 7, further comprising an optical space switch for routing the packet according to the output from the bit differential processor.

10. Method of processing a segment of x optical bit slots from a packet comprising y optical bit slots, each bit slot defining a respective one of first and second complementary logical states, using an all-optical switching device within a time span shorter than or equal to the time for receipt of the packet, characterised in that the method comprises the steps of:

(i) generating serial copies of the segment of the packet, each copy residing within a respective word containing z bit slots, where z is equal to or greater than x; and (ii) processing successive bits of the successive copies of the segment in n successive processing steps, the product of n and z being less than or equal to y, whereby the result of each processing step is output in sequence, the result of processing the segment being given by x successive bit slots of the output.

11. Method according to claim 10, further comprising the step of copying the segment to be processed from the packet prior to generating serial copies thereof.

12. Method according to claim 10, further comprising the step of routing the packet according to the output obtained from processing the segment.

13. Method according to claim 11, further comprising the step of routing the packet according to the output obtained from processing the segment.

* * * * *